US006913235B2

(12) United States Patent
Oberhaus

(10) Patent No.: US 6,913,235 B2
(45) Date of Patent: Jul. 5, 2005

(54) SYMMETRICALLY DESIGNED SNAP-ON SHELF

(75) Inventor: Fred D. Oberhaus, Chesterfield, MO (US)

(73) Assignee: Industrial Wire Products, Inc., Sullivan, MO (US)

( * ) Notice: Subject to any disclaimer, the term of this patent is extended or adjusted under 35 U.S.C. 154(b) by 0 days.

(21) Appl. No.: 10/676,932

(22) Filed: Oct. 1, 2003

(65) Prior Publication Data

US 2004/0104324 A1 Jun. 3, 2004

Related U.S. Application Data

(63) Continuation-in-part of application No. 29/168,754, filed on Oct. 9, 2002, now Pat. No. Des. 485,109.

(60) Provisional application No. 60/416,433, filed on Oct. 7, 2002.

(51) Int. Cl.[7] ..... A47G 29/02; E04G 3/08; E06B 7/28

(52) U.S. Cl. ..... 248/250; 248/249

(58) Field of Search ..... 248/249, 250, 248/251; 211/123

(56) References Cited

U.S. PATENT DOCUMENTS 1,576,784 A * 3/1926 Planett ..... 43/109
4,624,376 A * 11/1986 Bertram ..... 211/187
4,708,552 A 11/1987 Bustos et al.
4,732,284 A * 3/1988 Remmers ..... 211/188
D295,472 S 5/1988 Remmers
4,781,349 A 11/1988 Remmers
4,783,035 A 11/1988 Remmers
D312,389 S 11/1990 Remmers
5,326,062 A 7/1994 Remmers
5,346,077 A 9/1994 Randall
5,351,842 A * 10/1994 Remmers ..... 211/90.03
5,407,084 A 4/1995 Remmers
D369,293 S 4/1996 Gusdorf et al.
5,580,018 A 12/1996 Remmers
D378,481 S 3/1997 Oberhaus et al.
D389,729 S * 1/1998 Boeshart ..... D8/380
5,752,610 A 5/1998 Remmers
D400,781 S * 11/1998 Wilkening et al. ..... D8/381
D408,175 S 4/1999 Daniels et al.
D427,466 S 7/2000 Remmers
D437,515 S 2/2001 Remmers et al.
6,302,502 B1 * 10/2001 Larsen, Jr. ..... 312/334.4
6,402,108 B1 6/2002 Remmers
6,520,353 B2 * 2/2003 Fulbright ..... 211/153
6,672,226 B2 * 1/2004 Bohnacker ..... 108/108

* cited by examiner

*Primary Examiner*—Ramon O. Ramirez
*Assistant Examiner*—Amy J. Sterling
(74) *Attorney, Agent, or Firm*—Paul M. Denk

(57) ABSTRACT

A symmetrically formed wire shelf having front and back edges, of equivalent design and dimensions, are snap fastened to a complimentary bracket which accepts the various longitudinal rods of the wire shelf into a locking relationship when the wire shelf is installed onto two or more brackets, as the shelving is attached to the surface of a wall, door, or other vertical surface structure.

6 Claims, 2 Drawing Sheets

SYMMETRICALLY DESIGNED SNAP-ON SHELF

CROSS REFERENCE TO RELATED APPLICATION

The invention of this non-provisional patent application claims priority to the U.S. provisional patent application having Ser. No. 60/416,433, which was filed on Oct. 7, 2002, and which claims priority to and is a continuation in part of the design patent application having Ser. No. 29/168,754 now U.S. Pat. No. 485,109, which was filed on Oct. 9, 2002. Both of the above referenced patent applications are owned by a common assignee.

BACKGROUND OF THE INVENTION

A variety of shelving, stacking shelving, shelving supported by brackets, shelving which is adhered directly to a wall, or door, are readily available in art. For example, the storage shelf patented under U.S. Pat. No. Des. 378,481, shows a storage shelf, to one of the inventors as described herein, and which has been assigned to the same assignee as herein, which shelf can be applied to a bracket, wall, or the like, and provide reinforcement against bending, due to its structural integrity, and of the appearance as shown in this design patent.

Additional prior art owned by the same assignee as this current invention, discloses the design for a bracket, in U.S. design Pat. No. Des. 369,293, showing a bracket for adherence to the wall, a door, or the like, and which can have a shelf applied thereto, when the entire shelf and bracket are assembled for installation.

Other wire shelving and bracketing systems can be seen in the U.S. Pat. No. 5,346,077, disclosing a flanged lock type of bracket for mounting to a wall, and for supporting a shelf.

These are examples of the type of prior art shelving systems, and their holders, that have been used for applying shelving to a generally vertical wall surface area.

SUMMARY OF THE INVENTION

This invention principally relates to symmetrically designed shelving that can be snapped-on to end brackets and supported upon a wall, a door, or other surface.

This invention contemplates the formation of a wire fabricated shelving, which is symmetrical in width, and of the same configuration integrally along its front and back edges, so that the shelf, when applied to its brackets, need not particularly furnish a front part of the shelf, or back part of the shelf, but rather, because of its symmetrical design, can be snapped into position regardless which edge is provided at the front. The particular brackets used in combination with the shelf is a molded bracket, and includes clearance at both its front edge, and back edge, and incorporates aligned slots at these opposite edges, so that the shelf, and particularly at its down turned ends, can snap fasten into the bracket slots, be quickly and stably installed, and immediately available for usage, after the brackets, and their integral base plates, have been fastened to the supporting wall, door, or other vertical structure.

In addition, because of the symmetry of the shelving at both its front and back edges, the brackets, likewise, are of the same design, and regardless rather the brackets are applied to the left side of the shelf, or the right side of the shelf, during their installation, are readily available for acceptance of the shelving, when snapped into a locked position for usage.

It is, therefore, the principal object of this invention to provide a symmetrically designed shelf for use in conjunction with brackets and which can be conveniently and stably snapped into position, when readied for usage.

Still another object of this invention is to provide shelving that is ambidextrous of design and its front or back edges may be reversed, when installed, and function identically during usage.

Still another object of this invention is to provide an integrated bracket that can be applied to either the left or right edges of the shelving, when installed.

Still another object of this invention is to provide shelving that incorporates lateral reinforcement rods at the downwardly bent front and back edges and which are snapped into grooved positions provided upon such brackets to securely hold the shelving in place, during usage, obviating the need of any other fasteners to stably hold the shelf during usage.

These and other objects may become more apparent to those skilled in the art upon review of the invention as described herein, and upon undertaking a study of the description of its preferred embodiment, in view of the drawings.

DESCRIPTION OF THE PREFERRED EMBODIMENT

Figure 1:
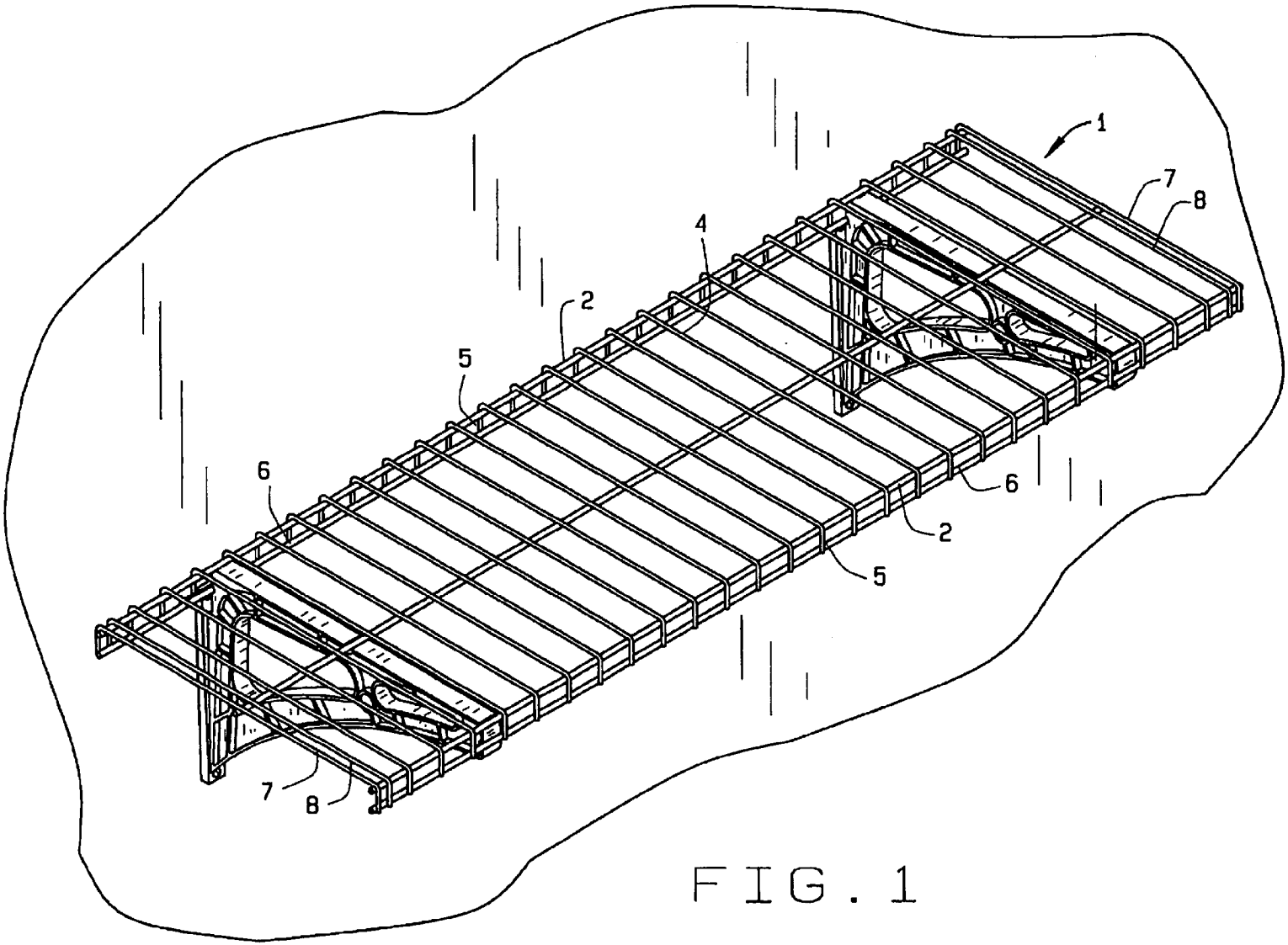
FIG. 1 provides an isometric view of the symmetrically designed snap-on shelf for application by brackets to a wall or other supporting surface.
Figure 2:
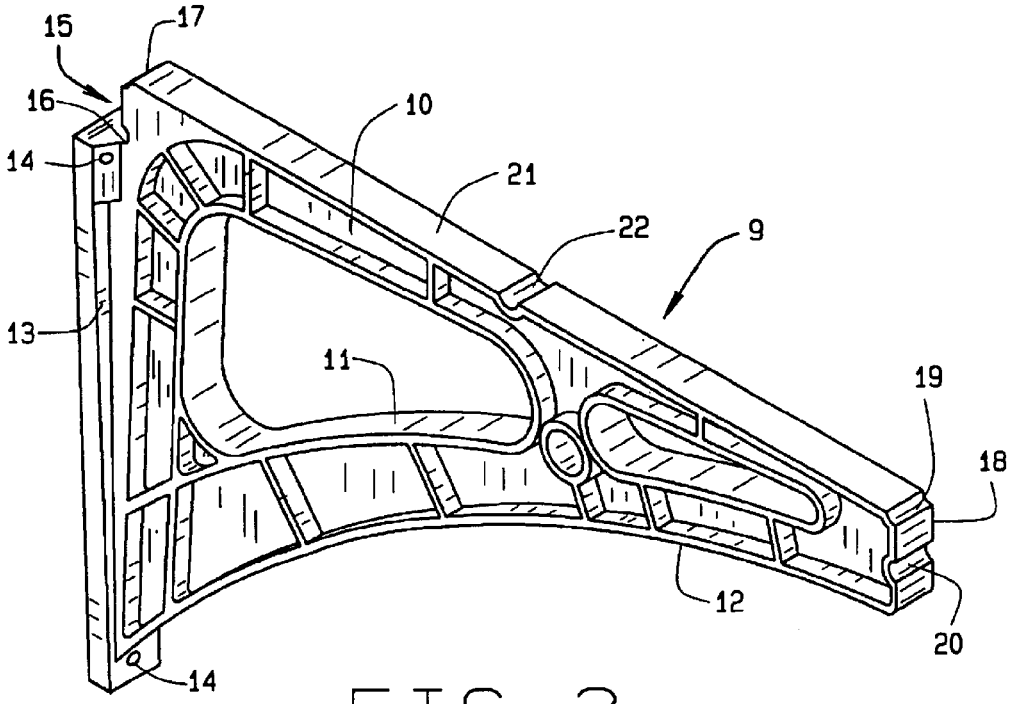
FIG. 2 is an isometric view of one of the brackets of FIG. 1.

In referring to the drawings, and in particular FIG. 1, the symmetrically designed shelf 1 of this invention is readily disclosed. As can be seen, it includes a series of longitudinally arranged structural rods 2 provided along the front and back edges of the designed shelf, and a mid point rod 3 provided intermediate thereof. In addition, a series of laterally extending shelf rods 4 are provided, arranged along the length of the shelf, with the entire assembly of rods being welded together, to provide securement of the wire shelf into its integral structure. The lateral rods 4 are bent downwardly, as at 5, at both their front and back edges, and are otherwise secured to the depending lower longitudinally extending rods 6 as can be noted.

Thus, the shelf, when formed, is designed to function for a variety of purposes. One, it provides structural integrity because of the downward bend of the lateral rods 4, as noted at 5, and secondly, the lower rods 6 add reinforcement at the front and back edges of the shelf, as designed. Furthermore, additional lateral rods are provided at the ends, as at 7 and 8, to add further structural integrity to the shelf at these locations. Secondly, designing the shelf in this manner, where both the front and back edges have symmetry, of design, it makes no difference which edge of the shelf is installed to the front, or the back, since either way, the shelf can be installed when assembled upon its brackets, to function as a wall shelf, as can be understood.

As previously summarized, the shelf may be installed against a wall, a door, or any other approximate vertical surface, to provide shelving, of the design as shown.

In addition, at each approximate end of the shelf is provided a bracket 9, and which is designed for accommodating the application of the wire shelf thereto, as to be described. As noted, the bracket includes an integral bracket structure 10 which is reinforced with various ribs 11, having a lower rib 12 and which are connected or otherwise integrally formed with a base plate 13 as noted. The base plate 13 includes apertures, as at 14, to either side, so that a series of fasteners, such as screws, dry wall bolts, or the like, can be fastened therethrough, for attachment of the bracket to a wall, when installed.

In addition, it is to be noted that the base plate provides clearance, as at 15, at the back side of the bracket, and further includes a formed groove 16 therein, while the upper edge of the bracket, as at 17, forms a slight bevel, or arcuate groove, so that when the shelf is installed initially, the rods 2 and 6 can insert within their respective grooves 17 and 16, and hold that part of the shelf in place, as it is being installed, as during installation.

It is to be particularly noted that in the assembly and installation of this shelf, the brackets themselves, initially, are applied to the surface of the wall, door, or the like. Once they are installed, then the shelf 1 can be installed. This is done by inserting the back end of the shelf, as along its rods 2 and 6, which are slid into the clearance area 15, and then pulled forwardly and snapped into position at the front 18 of the brackets, as can be seen.

In addition, the front ends of the bracket as at 18, includes grooves 19 and 20, and are designed for accommodating the lower edge rods 2 and 6, of the shelf, at the frontal location, which are snapped against their resiliency into place upon the bracket, as the shelf is being installed. Obviously, at least a pair of the brackets will have previously been installed along a horizontal alignment to the wall or door, in preparation for acceptance of the shelf, in position, during installation.

In addition, and since the shelving preferably includes, but does not necessarily require, a mid point longitudinal rod 3, the upper rib 21 of each bracket includes a further groove 22, at its mid point, so as to accommodate the location of the longitudinal rod 3 therein, when the shelving is installed.

Figure 3:
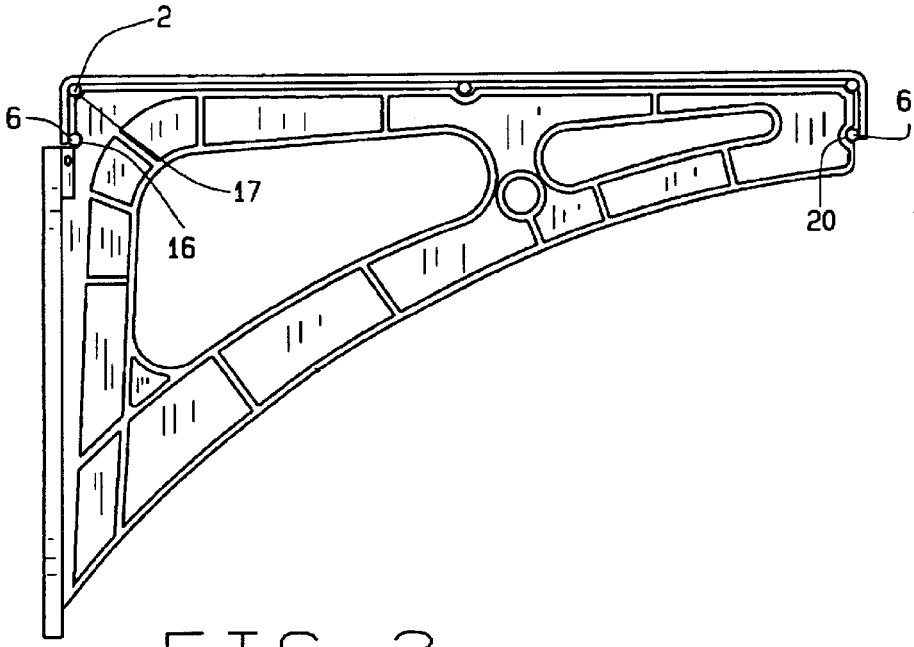
FIG. 3 is a side view of the bracket, with the shelf applied, when installed to a supporting surface.

This relationship between the shelving, its various longitudinal rods, the grooves formed associated with the upper region of each bracket, can be readily seen from the assembled shelving, as noted in FIG. 3.

Figure 4:
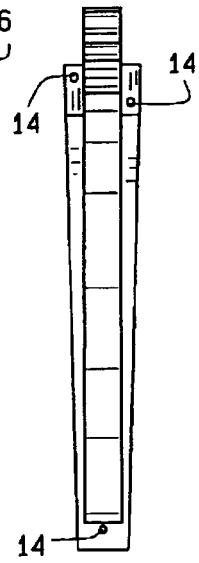
FIG. 4 is a front view of the bracket of this invention.

FIG. 4 provides a front view of the individual brackets, where two or more of such brackets are used for supporting the snap-on shelf in position against a supporting surface. Obviously, fasteners or screws can be applied through the apertures 14, to secure each bracket in place.

As can be understood, the shelving, because of its length, and because it is formed of wire structure, and because the lateral width of the shelving will be of some significant length, approximately twelve inches (12"), eighteen inches (18"), twenty four inches (24"), more or less, of design, such shelving will have some inherent resiliency, that will allow its eventual front edge to be bowed outwardly, to furnish clearance for locating of the lower longitudinal rod 6 within its associated groove 20, as the shelving is being installed. Obviously, the back edge longitudinal rods 2 and 6 will have previously been inserted within their respective grooves 17 and 16, as explained.

While the shelving will generally be formed of assembled wire components, in the manner as previously explained, the brackets generally will be fabricated and molded from preferably a polymer, although other forms of bracketing may be employed for this purpose, provided that they incorporate the various structures for accommodating the symmetrical shelf, in place, when assembled, and when used.

Variations or modifications to the subject matter of this invention may occur to those skilled in the art upon review of the invention as described herein. Such variations, if within the spirit of this development, are intended to be encompassed within the scope of the invention as described. The description of the preferred embodiment, and as shown in the drawings, is furnished for illustrative purposes only.

What is claimed is:

1. A symmetrically designed snap-on shelf incorporating a length of wire structure shelf, at least a pair of brackets provided for structurally cooperating with the wire shelf to support said shelf when installed against a supporting surface, each bracket having selectively located grooves for accommodating portions of the wire structure of the shelf when the shelf is engaged for resting upon the brackets for supporting other items when installed upon a supporting surface, each wire shelf has a series of longitudinal rods provided within its structure, a pair of vertically aligned longitudinal rods provided at both the front edge and the back edge of said wire shelf, said pair of rods at the front edge and back edge being at the same vertical alignment and the same distance apart and because of its symmetry the wire shelf can be applied to its supporting brackets regardless whether the front or back edges of the wire shelf face forwardly, said bracket having clearance slots provided approximate their upper front and back edges, for accommodating the locating of the wire shelf longitudinal rods therein when the shelf is pressure fitted for snap engagement with the brackets for securement to a supporting surface, the front edge of each bracket has a pair of said clearance slots, said slots being arranged one above the other, and being at a distance apart so as to accommodate therein the pair of longitudinal rods provided at either the front edge or back edge of the shelf, when the shelf is engaged with its brackets, each bracket having an integral faceplate formed at its back edge, the combination of the base plate and the upper back edge of the bracket forming a clearance slot for accommodating the insertion of a pair of the downwardly arranged longitudinal rods at the back edge of the shelf when connected to its brackets, each bracket incorporating its vertically extending base plate, and forwardly extending shelf supporting surface, and reinforcing structure extending between the supporting surface and the base plate to provide structural support for any item ladened shelf when mounted upon the supporting surface, and the symmetrical design of the snap-on shelf allows the wire shelf to be pressure fitted for snap engagement within the front and back slots of each bracket regardless whether the front or back edges of said shelf and its vertically aligned pair of rods face forwardly.

2. The snap-on shelf of claim 1 and including a further longitudinal rod provided along the length of the shelf at approximate the midpoint between its front and back edges, said midpoint longitudinal rod provided for adding reinforcement to the structure of the shelf, and each bracket having a clearance slot provided within its upper middle surface to provide clearance for insertion of the longitudinal rod therein when the shelf is pressure engaged to the brackets for connecting to a supporting surface.

3. The snap-on shelf of claim 1 wherein each plate has more than one aperture provided therethrough for accommodating a fastener for securement of the snap-on shelf and its brackets to a supporting surface.

4. The snap-on shelf of claim 1 wherein the supporting structure of each bracket having at least one opening provided therethrough, and reinforcing ribs provided within the structure of the bracket surrounding the opening to add reinforcement to the bracket, when installed.

5. The snap-on shelf of claim 1 wherein the upper back edge of each supporting surface of a bracket, having a bevel provided thereat, to facilitate the insertion of the back edge of each shelf into the base plate slot when installing a shelf onto at least a pair of mounted brackets.

6. The snap-on shelf of claim 5 wherein each shelf has a length of at least 12 inches, and not exceeding 48 inches, and each shelf having sufficient and inherent resiliency to allow for the pair of longitudinal rods formed at its front edge to be bowed outwardly to furnish clearance for snap engagement of the shelf onto the front of each supporting bracket when installed.

* * * * *